US008659633B2

(12) United States Patent
Kondo

(10) Patent No.: US 8,659,633 B2
(45) Date of Patent: Feb. 25, 2014

(54) LIGHT SOURCE CONTROL APPARATUS USED IN IMAGE FORMING APPARATUS USING ELECTROPHOTOGRAPHY PROCESS, CONTROL METHOD THEREFOR, STORAGE MEDIUM STORING CONTROL PROGRAM THEREFOR, AND IMAGE FORMING APPARATUS

(71) Applicant: Canon Kabushiki Kaisha, Tokyo (JP)

(72) Inventor: Shunsaku Kondo, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/645,635

(22) Filed: Oct. 5, 2012

(65) Prior Publication Data

US 2013/0093825 A1 Apr. 18, 2013

(30) Foreign Application Priority Data

Oct. 17, 2011 (JP) ..... 2011-227821

(51) Int. Cl.
*B41J 2/435* (2006.01)

(52) U.S. Cl.
USPC ..... 347/236; 347/246

(58) Field of Classification Search
USPC ..... 347/236, 237, 246, 247
See application file for complete search history.

(56) References Cited

U.S. PATENT DOCUMENTS 7,852,363 B2 * 12/2010 Kawamoto ..... 347/237

FOREIGN PATENT DOCUMENTS

JP 2001-308449 A 11/2001
JP 2011046064 A * 3/2011 ..... B41J 2/44

* cited by examiner

*Primary Examiner* — Hai C Pham
(74) *Attorney, Agent, or Firm* — Rossi, Kimms & McDowell LLP

(57) ABSTRACT

A light source control apparatus that do not always require calculations for the upper limit of driving current when characteristic of a light source varies. The light source control apparatus controls a light source that exhibits a characteristic including an uptrend region where the light amount increases with increasing driving current and a downtrend region where the light amount decreases with increasing driving current. A determination unit determines whether the light source is in the uptrend or downtrend region based on signals from a light variation detection unit and a current variation detection unit. A control unit matches the light amount (L) with target light amount (T), by increasing the driving current when L<T in the uptrend region or when L>T in the downtrend region, and by decreasing the driving current when L>T in the uptrend region and when L<T in the downtrend region.

8 Claims, 10 Drawing Sheets

*FIG. 6*

| | ⊿Isw | ⊿Vim | DETERMINATION | CONTROL MODE |
|---|---|---|---|---|
| STATE A | >0 | >0 | UPTREND REGION | FIRST CONTROL MODE |
| STATE B | <0 | <0 | UPTREND REGION | SECOND CONTROL MODE |
| STATE C | >0 | <0 | DOWNTREND REGION | FOURTH CONTROL MODE |
| STATE D | <0 | >0 | DOWNTREND REGION | THIRD CONTROL MODE |

LIGHT SOURCE CONTROL APPARATUS USED IN IMAGE FORMING APPARATUS USING ELECTROPHOTOGRAPHY PROCESS, CONTROL METHOD THEREFOR, STORAGE MEDIUM STORING CONTROL PROGRAM THEREFOR, AND IMAGE FORMING APPARATUS

BACKGROUND OF THE INVENTION

1. Field of the Invention

The present invention relates to a light source control apparatus used in an image forming apparatus using an electrophotography process, a control method therefor, a storage medium storing a control program therefor, and the image forming apparatus.

2. Description of the Related Art

There are some light source control apparatuses that are used in image forming apparatuses using an electrophotography process are provided with surface emitting lasers as light sources, in general. Although oscillation threshold current of a surface emitting laser is lower than that of an edge emitting laser, a linear area of a current-light characteristic of the surface emitting laser is smaller than that of the edge emitting laser. An optical output of the surface emitting laser increases to the maximum optical output and decreases as driving current increases. Even when the driving current again becomes lower than the value corresponding to the maximum optical output, the surface emitting laser can oscillate. However, when a light control (APC: Auto Power Control) is performed over both of an area in which an optical output increases with increasing driving current and an area in which an optical output decreases with increasing driving current, the surface emitting laser may oscillate in a multimode. Japanese Laid-Open Patent Publication (Kokai) No. 2001-308449 (JP 2001-308449A) discloses a technique that restricts driving current below the value corresponding to the maximum optical output so that a light control is not performed in an area beyond the maximum light amount.

The technique described in the publication determines the maximum light amount that is the optical output where an increasing ratio of the optical output of the surface emitting laser becomes almost zero after the driving current exceeds oscillation threshold current while increasing the driving current gradually and monitoring the light amount of the surface emitting laser. Then, the driving current when the maximum light amount is acquired is specified as an upper limit. Then, an APC circuit controls the light amount so that the driving current does not exceed the upper limit.

Incidentally, when the current-light characteristic of the surface emitting laser varies due to variation of an environmental temperature, it is necessary to calculate the above-mentioned upper limit each time as mentioned below.

As shown in FIG. 4, the optical output of a surface emitting laser monotonously increases until reaching the maximum light amount as applied current gradually increases from zero. The value of the driving current corresponding to the maximum light amount is expressed as Ipeak. When the driving current increases beyond Ipeak, the optical output of the surface emitting laser decreases in monotone. That is, when the driving current increases after reaching the maximum light amount, the optical output decreases as the driving current increases.

It is assumed that the surface emitting laser (called a light emission point, hereafter) is driven by the driving current Is under the APC and operates at a point S where target light amount is acquired at a temperature A, as shown in FIG. 5A.

In this case, the high light emission frequency of the light emission point increases the temperature of the light emission point due to the heating of the light emission point itself, which varies the current-light characteristic. For example, it is assumed that the variation of the temperature to B from A varies the current-light characteristic to a curve shown by the temperature B from a curve shown by the temperature A. In this time, when the light emission point is driven by the driving current Is, the operation point of the light emission point shifts to a point S' as shown in FIG. 5B.

When the operation point of the light emission point shifts to the point S', the light amount of the light emission point decreases. When the light amount of the light emission point decreases, a CPU will recognize the insufficient light amount in the following APC loop. Accordingly, an APC circuit increases the driving current applied to the light emission point so that the light amount of the light emission point reaches the target light amount based on an instruction from the CPU.

However, the light amount does not reach the target light amount even if the driving current exceeds Ipeak corresponding to the peak light amount, and the APC circuit further increases the driving current (see FIG. 5B). Then, even if the temperature of the light emission point returns from the temperature B to the temperature A immediately, the APC circuit controls to increase the driving current in order to raise the light amount (see FIG. 5C). As a result, although the light amount would reach the target light amount at a point Q when being driven by the driving current Iq, the light amount does not reach the target light amount because the APC circuit controls to increase the driving current.

When the light emission point is operating in the downtrend region, the light amount does not reach the target light amount by increasing the driving current. This does not converge the APC and stops the image formation. Oversupply of the driving current to the emission point in the downtrend region may break the light emission point.

Thus, when the characteristic of the surface emitting laser varies with a temperature variation, the electric current value corresponding to the peak light amount also varies. Accordingly, whenever the characteristics of the surface emitting laser varies, the upper limit of the driving current must be calculated as mentioned above, and the image formation takes long time due to such calculations.

SUMMARY OF THE INVENTION

The present invention provides a light source control apparatus, a control method therefor, a storage medium storing a control program therefor, and an image forming apparatus, which do not always require calculations for the upper limit of the driving current when the characteristic of a light source varies, and do not take long time for forming an image.

Accordingly, a first aspect of the present invention provides a light source control apparatus comprising, a light source configured to output a light beam of which light amount depends on supplied driving current, wherein a current-light characteristic of the light source includes an uptrend region where the light amount increases with increasing driving current and a downtrend region that touches the uptrend region at a peak value of the light amount and where the light amount decreases with increasing driving current, a light variation detection unit configured to detect variation of the light amount of the light beam outputted from the light source and to output a light variation detection signal, a current variation detection unit configured to detect variation of the driving current and to output a current variation detection signal, a determination unit configured to determine whether the light source is operating in the uptrend region or in the downtrend region based on the light variation detection signal and the current variation detection signal, and a control unit configured to control the driving current so as to match the light amount of the light beam with predetermined target light amount, by increasing the driving current when the determination unit determines that the light source is operating in the uptrend region and when the light amount of light beam is less than the target light amount or when the determination unit determines that the light source is operating in the downtrend region and when the light amount of light beam exceeds the target light amount, and by decreasing the driving current when the determination unit determines that the light source is operating in the uptrend region and when the light amount of light beam exceeds the target light amount or when the determination unit determines that the light source is operating in the downtrend region and when the light amount of light beam is less than the target light amount.

Accordingly, a second aspect of the present invention provides a control method for a light source control apparatus that controls a light source that outputs a light beam of which light amount depends on supplied driving current and that exhibits a current-light characteristic including an uptrend region where the light amount increases with increasing driving current and a downtrend region that touches the uptrend region at a peak value of the light amount and where the light amount decreases with increasing driving current, the control method comprising a light variation detection step of detecting variation of the light amount of the light beam outputted from the light source and to output a light variation detection signal, a current variation detection step of detecting variation of the driving current and to output a current variation detection signal, a determination step of determining whether the light source is operating in the uptrend region or in the downtrend region based on the light variation detection signal and the current variation detection signal, and a control step of controlling the driving current so as to match the light amount of the light beam with predetermined target light amount, by increasing the driving current when it is determined that the light source is operating in the uptrend region in the determination step and when the light amount of light beam is less than the target light amount or when it is determined that the light source is operating in the downtrend region in the determination step and when the light amount of light beam exceeds the target light amount, and by decreasing the driving current when it is determined that the light source is operating in the uptrend region in the determination step and when the light amount of light beam exceeds the target light amount or when it is determined that the light source is operating in the downtrend region in the determination step and when the light amount of light beam is less than the target light amount.

Accordingly, a third aspect of the present invention provides a non-transitory computer-readable storage medium storing a control program causing a computer to execute the control method according to the second aspect.

Accordingly, a fourth aspect of the present invention provides an image forming apparatus comprising the light source control apparatus according to the first aspect, a development unit configured to develop an electrostatic latent image formed on a photoconductor by exposing to a light beam emitted from a light source in order to form a toner image, and a transferring unit configured to transfer the toner image on the photoconductor to a recording sheet to form an image.

Accordingly, a fifth aspect of the present invention provides an image forming apparatus comprising the light source control apparatus according to the first aspect wherein the control unit decreases the target light amount by predetermined amount when the light source is operating in the downtrend region, a development unit configured to develop an electrostatic latent image formed on a photoconductor by exposing to a light beam emitted from a light source in order to form a toner image, a bias change unit configured to changes development bias voltage applied to the development unit when the control unit decreases the target light amount by predetermined amount, and a transferring unit configured to transfer the toner image on the photoconductor to a recording sheet to form an image.

Further features of the present invention will become apparent from the following description of exemplary embodiments with reference to the attached drawings.

BRIEF DESCRIPTION OF THE DRAWINGS

FIG. 6 is a view showing criteria used by a CPU shown in FIG. 3.

DESCRIPTION OF THE EMBODIMENTS

Hereafter, embodiments according to the present invention will be described in detail with reference to the drawings.

Figure 1:
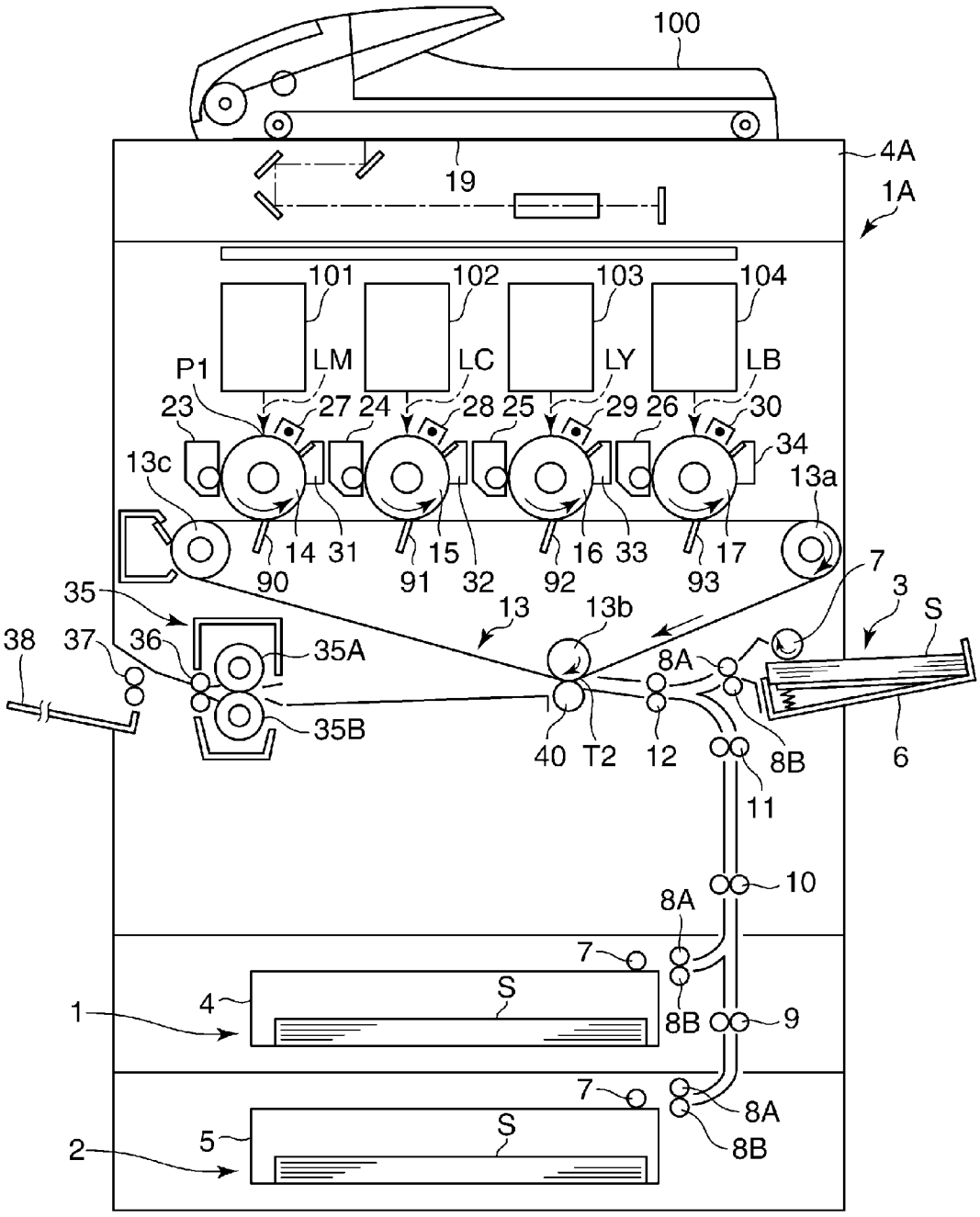
FIG. 1 is a view showing a configuration example of an image forming apparatus using an optical scanning apparatus that includes a light source control apparatus according to a first embodiment of the present invention.

FIG. 1 is a view showing a configuration example of an image forming apparatus using an optical scanning apparatus that includes a light source control apparatus according to a first embodiment of the present invention. The image forming apparatus 1A shown in FIG. 1 forms a color image by overlapping images of cyan (C), magenta (M), yellow (Y), and black (K).

The illustrated image forming apparatus 1A has four photosensitive drums (photoconductors: exposure surfaces) 14, 15, 16, and 17. An intermediate transfer belt (endless belt) 13, which is an intermediate transfer medium, is arranged so as to face these photosensitive drums 14, 15, 16, and 17. The intermediate transfer belt 13 is looped over a driving roller 13*a*, a secondary transfer opposite roller 13*b*, and a tension roller (driven roller) 13*c*. The sectional shape of the belt 13 is approximately triangular. Then, the intermediate transfer belt 13 rotates in the clockwise direction (the direction shown by a solid line arrow) in FIG. 1.

The photosensitive drums 14, 15, 16, and 17 are sequentially arranged along the intermediate transfer belt 13 from the upper stream side in the rotating direction of the intermediate transfer belt 13 in the illustrated example. An electrostatic charger 27, a development device 23, and a cleaner 31 are arranged around the photosensitive drum 14. Similarly, electrostatic chargers 28, 29 and 30, development devices 24, 25, and 16, cleaners 32, 33, and 34 are arranged around the photosensitive drums 15, 16, and 17, respectively.

The electrostatic chargers 27, 28, 29, and 30 uniformly electrify the surfaces of the photosensitive drums 14, 15, 16, and 17, respectively. Exposure units 101, 102, 103, and 104 are arranged over the photosensitive drums 14, 15, 16, and 17, respectively, as optical scanning apparatuses. The exposure units 101, 102, 103, and 104 scan the surfaces of the photosensitive drums 14, 15, 16, and 17 with laser beams (light beams) according to image data, respectively.

It should be noted that the photosensitive drums 14, 15, 16, and 17 corresponds to magenta (M), cyan (C), yellow (Y), and black (K) toners, respectively, in the illustrated example.

Hereafter, an image formation (print) operation in the illustrated image forming apparatus 1A will be described. The illustrated image forming apparatus 1A has cassette sheet feeding units 1 and 2, and a manual feeding unit 3. A recording sheet (transfer paper) S is fed from one of the cassette sheet feeding units 1 and 2 and the manual feeding unit 3. The cassette sheet feeding units 1 and 2 have cassettes 4 and 5, respectively, and the manual feeding unit 3 has a tray 6. The transfer sheets S are stacked on the cassettes 4 and 5 or the tray 6, and the uppermost one of the transfer sheets S is picked up by a pickup roller 7. Then, only the picked-up transfer sheet S is separated from other sheets by a separation roller pair 8 that consists of a feed roller 8A and a retard roller 8B.

The transfer sheet S sent out from the cassette sheet feeding unit 1 or 2 is sent to a registration roller pair 12 by conveying roller pairs 9, 10, and 11. On the other hand, the transfer sheet S sent from the manual feeding unit 3 is directly sent to the registration roller pair 12. Then, the registration roller pair 12 once stops the movement of the transfer sheet S, and corrects a skew state thereof.

The image forming apparatus 1A is provided with an original feeding device 100 that conveys originals onto a contact glass 19 one by one. When an original is conveyed to a specified position on the contact glass 19, the scanner unit 4A irradiates the original, and the reflected light from the original is guided to a lens via a mirror etc. The reflected light forms an optical image on an image sensing unit (not shown).

The image sensing unit converts the optical image into an electrical signal by photoelectric conversion. The electrical signal is inputted into an image processing unit (not shown). The image processing unit converts the electrical signal into a digital signal, and then, generates image data by applying necessary image processing to the digital signal concerned.

The image data is directly inputted into the exposure units 101 through 104 or is inputted via an image memory (not shown). The exposure units 101 through 104 correspond to magenta (M), cyan (C), yellow (Y), and black (K), respectively. Then, the exposure units 101 through 104 drive semiconductor lasers (surface emitting lasers, not shown) according to the image data of the respective colors. The semiconductor laser with which the exposure units 101, 102, 103, and 104 are provided emit laser beams LM, LC, LY, and LB.

The laser beams LM, LC, LY, and LB irradiate the surfaces of the photosensitive drums 14, 15, 16, and 17 through a scanning system containing a rotational polygon mirror. These laser beams LM, LC, LY, and LB scan the photosensitive drums 14, 15, 16, and 17 in the principal scanning direction (the axial direction of the photosensitive drums 14, 15, 16, and 17).

The photosensitive drums 14, 15, 16, and 17 are rotating in the direction (the auxiliary scanning direction) shown by solid line arrows in FIG. 1, and thereby the photosensitive drums 14, 15, 16, and 17 are scanned by the laser beams LM, LC, LY, and LB also in the auxiliary scanning direction. The scans of the laser beams LM, LC, LY, and LB form electrostatic latent images corresponding to the image data on the photosensitive drums 14, 15, 16, and 17.

Thus, the photosensitive drum 14 located in the most upstream position is exposed with the laser beam LM according to the image data of the M component. Accordingly, an electrostatic latent image is formed on the photosensitive drum 14. The electrostatic latent image on the photoconductive drum 14 is developed by the development device 23 and becomes an M toner image.

Next, when predetermined time elapses from the exposure start of the photosensitive drum 14, the photosensitive drum 15 is exposed with the laser beam LC according to the image data of the C component. Accordingly, an electrostatic latent image is formed on the photosensitive drum 15. The electrostatic latent image on the photoconductive drum 15 is developed by the development device 24 and becomes a C toner image.

Next, when the predetermined time elapses from the exposure start of the photosensitive drum 15, the photosensitive drum 16 is exposed with the laser beam LY according to the image data of the Y component. Accordingly, an electrostatic latent image is formed on the photosensitive drum 16. The electrostatic latent image on the photoconductive drum 16 is developed by the development device 25 and becomes a Y toner image.

Then, when the predetermined time elapses from the exposure start of the photosensitive drum 16, the photosensitive drum 17 is exposed with the laser beam LB according to the image data of the K component. Accordingly, an electrostatic latent image is formed on the photosensitive drum 17. The electrostatic latent image on the photoconductive drum 17 is developed by the development device 25 and becomes a K toner image.

The M toner image on the photosensitive drum 14 is transferred onto the intermediate transfer belt 13 by a transferring charging unit (a transferring unit) 90. Similarly, the C toner image, Y toner image, and K toner image on the photosensitive drums 15, 16, and 17 are transferred onto the intermediate transfer belt 13 by transferring charging units 91, 92, and 93, respectively.

The M toner image, C toner image, Y toner image, and K toner image are transferred and are piled up on the intermediate transfer belt 13 one by one, and a color toner image is formed as a primary transferred image on the intermediate transfer belt 13.

It should be noted that residual toner on the photosensitive drums 14, 15, 16, and 17 is removed by the cleaners 31, 32, 33, and 34 after transferring, respectively.

The transfer paper S that was once stopped by the registration roller pair 12 is conveyed to a secondary transfer position T2 by the registration roller pair 12. The registration roller pair 12 is driven to rotate at the timing when the color toner image on the intermediate transfer belt 13 aligns with the front end of the transfer sheet S, which conveys the transfer sheet S to the secondary transfer position T2.

A secondary transfer roller 40 and a secondary transfer opposite roller 13*b* are arranged at the secondary transfer position T2. The color toner image on the intermediate transfer belt 13 is transferred onto the transfer sheet (recording sheet) S as a secondary transferred image at the secondary transfer position T2.

The transfer sheet S which passed the secondary transfer position T2 is sent to a fixing device 35. The fixing device 35 has a fixing roller 35A and a pressure roller 35B. When the transfer sheet S passes a nip position between the fixing roller 35A and the pressure roller 35B, the fixing roller 35A heats the transfer sheet S and the pressure roller 35B pressurizes the transfer sheet S. Accordingly, the fixing device 35 fixes the secondary transferred image onto the transfer sheet S.

The fixed transfer sheet S is sent to an ejection roller pair 37 by a conveying roller pair 36, and is ejected by the ejection roller pair 37 onto an ejection tray 38.

Figure 2:
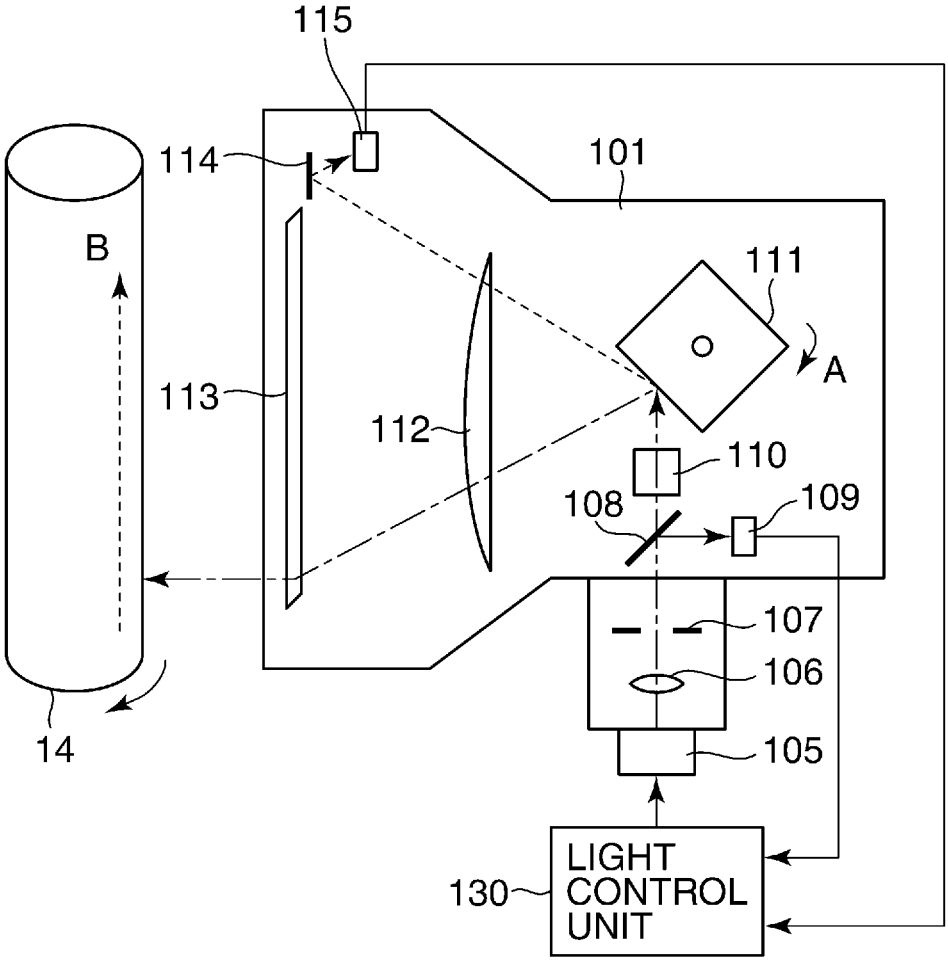
FIG. 2 is a view showing a configuration example of an exposure unit with which the image forming apparatus shown in FIG. 1 is provided.

FIG. 2 is a view showing a configuration example of the exposure unit with which the image forming apparatus shown in FIG. 1 is provided. Although the exposure unit is provided for each color as mentioned above, the exposure unit 101 corresponding to magenta (M) will be described as a representative because the each unit has the same configuration.

The exposure unit 101 uses a semiconductor laser that generates a plurality of beams to meet improvements in the speed and definition, and thereby, a plurality of scan lines are formed by one scan by the polygon mirror.

As shown in FIG. 2, the exposure unit 101 has a laser light source (a surface emitting laser: LD) 105. The laser light source 105 has a plurality of light emission points. Laser beams (divergent lights) emitted from the LD 105 are converted into substantially parallel beams by a collimator lens 106. The diameters of the parallel beams are restricted by an aperture stop 107, and then, the beams enter into a half mirror 108. A part of each of the incident laser beams is reflected by the half mirror 108 and enters into a photosensor 109. The photosensor 109 detects the light amount of the laser beam, and gives the detected light amount to a light control unit 130.

The laser beam that transmits the half mirror 108 enters into a cylindrical lens 110. The cylindrical lens 110 has predetermined refractive power in the auxiliary scanning direction of the photosensitive drum 14, converges the laser beam onto the reflective surface of a polygon mirror 111 in a section in the auxiliary scanning direction, and forms a latent image.

The polygon mirror 111 is driven by a motor (not shown) so as to rotate in the direction shown by an arrow A in constant angular velocity. A laser beam is converted into a deflecting beam that continuously changes an angle as the polygon mirror 111 rotates. The deflecting beam forms a spot on the photosensitive drum 14 through an f-θ lens 112 and a folding mirror 113.

The rotation of the polygon mirror 111 makes the deflecting beam scan the photosensitive drum 14 in the direction of an arrow B (the principal scanning direction), and forms an electrostatic latent image on the photosensitive drum 14.

The laser beam reflected by the reflective mirror 114 arranged behind the f-θ lens 112 enters into a BD (Beam Detect) sensor 115. The BD sensor 115 detects the laser beam that enters into a light receiving surface. Then, the BD sensor 115 gives a detection output as a horizontal synchronization signal to the light control unit 130. The light control unit 130 performs APC (Auto Power Control) of the LD 105 according to the detected light amount and the horizontal synchronizing signal, as mentioned later.

Figure 3:
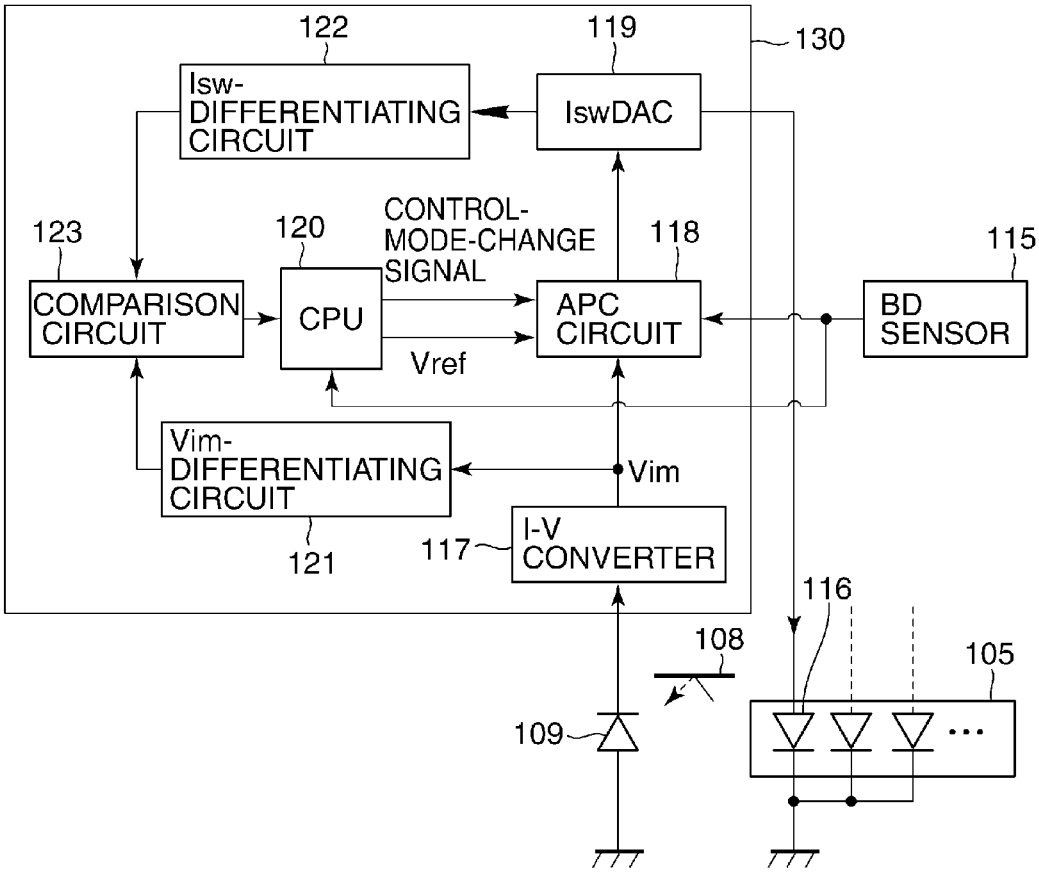
FIG. 3 is a block diagram schematically showing a configuration of a light control unit that is included in the exposure unit shown in FIG. 2.

FIG. 3 is a block diagram schematically showing a configuration of the light control unit 130 shown in FIG. 2.

The light control unit 130 is connected to the LD 105. The LD 105 has a plurality of light emission points (lasers) 116. The photosensor 109 outputs detected current corresponding to the detected light amount. The light control unit 130 has a current-voltage converter (I-V converter) 117, and the detected current is inputted into the I-V converter 117. The I-V converter 117 converts the detected current into detected voltage Vim. Then, the detected voltage Vim is inputted into an APC circuit 118 and a Vim-differentiating circuit 121.

A CPU 120 gives a reference voltage Vref and a control-mode-change signal to the APC circuit 118. The APC circuit 118 compares the detected voltage Vim and the reference voltage Vref, and directs a drive-current setting circuit (Isw-DAC) 119 to increase or decrease driving current so that the detected voltage Vim matches the reference voltage Vref. The IswDAC 119 adjusts driving current (Isw) applied to a light emission point 116 so that the light amount of the laser beam outputted from the light emission point 116 reaches predetermined target light amount that is sufficient to expose a photosensitive drum.

The APC circuit 118 selects one of the following four control modes according to the control-mode-change signal from the CPU 120. The first control mode increases the driving current in order to increase the light amount of laser beam. The second control mode decreases the driving current in order to decrease the light amount of laser beam. The third control mode decreases the driving current in order to increase the light amount of laser beam raise. And the fourth control mode increases the driving current in order to decrease the light amount of laser beam. It should be noted that the first and second control modes are included in an increase control, and the third and fourth control modes are included in a decrease control.

It should be noted that the APC circuit 118 performs the APC whenever a horizontal synchronizing signal is inputted from the BD sensor 115. Moreover, a horizontal synchronizing signal is also given to the CPU 120.

The light control unit 130 further has the Vim differentiating circuit 121, an Isw differentiating circuit 122, and a comparison circuit 123. The Vim differentiating circuit 121 differentiates the detected voltage Vim given from the I-V converter 117, and gives the result to the comparison circuit 123. In the light control unit 130, whenever the horizontal synchronization signal is received, the Vim differentiating circuit 121 detects variation (light amount variation) between the detection result (Vim1) in the last APC and the detection result (Vim2) in the current APC, and gives a Vim variation detection signal (a light variation detection signal) to the comparison circuit 123.

The Isw differentiating circuit 122 differentiates the driving current (Isw) given from the IswDAC 119, and gives the result to the comparison circuit 123. That is, the Isw differentiating circuit 122 detects variation (driving current variation) between the driving current (Isw) in the last APC and that in the current APC, and gives an Isw variation detection signal (a current variation detection signal) to the comparison circuit 123.

The comparison circuit 123 compares the Vim variation detection signal with the Isw variation detection signal, and gives a comparison result signal corresponding to the comparison result to the CPU 120. Then, the CPU 120 gives a control-mode-change signal to the APC circuit 118 according to the comparison result signal as mentioned later.

FIG. 6 is a view showing criteria used by the CPU 120 shown in FIG. 3.

Figure 4:
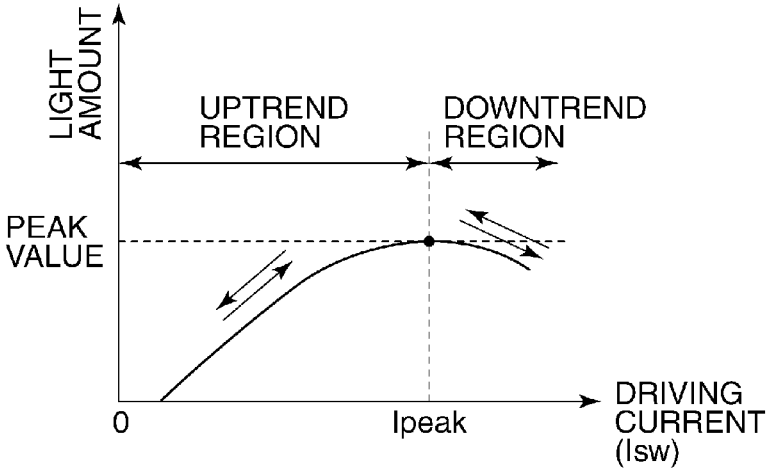
FIG. 4 is a graph showing a current-light characteristic of a surface emitting laser.
Figure 5A:
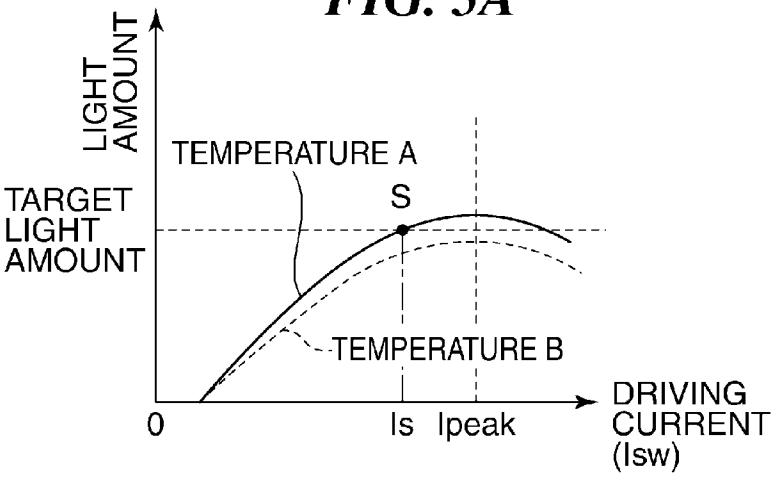
FIG. 5A is a graph showing the current-light characteristic of the surface emitting laser in which an operation point of the surface emitting laser by an APC at a predetermined temperature is indicated.
Figure 5B:
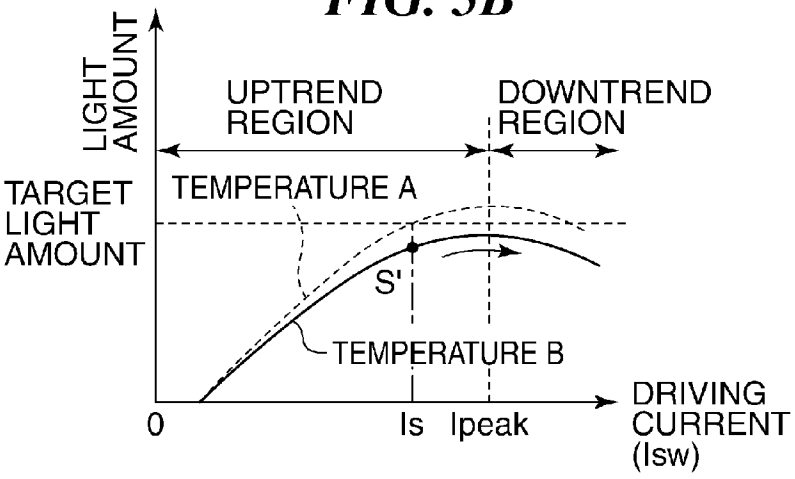
FIG. 5B is a graph showing the current-light characteristic of the surface emitting laser in which an operation point of the surface emitting laser that is driven by the same driving current at a higher temperature than the predetermined temperature, and variation of the driving current by the APC are indicated.
Figure 5C:
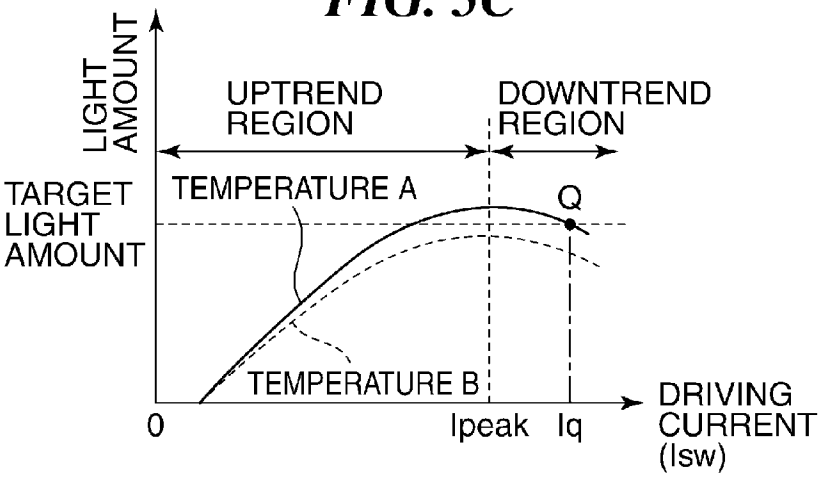
FIG. 5C is a graph showing the current-light characteristic of the surface emitting laser in which an operation point of the surface emitting laser of which the temperature increases to the higher temperature than the predetermined temperature and then returns to the predetermined temperature, and variation of the driving current by the APC are indicated.

As mentioned above, the comparison circuit 123 compares Isw and Vim in the last APC and that in the current APC, and outputs the comparison result signal. When Isw is increasing ($\Delta Isw>0$) and Vim is increasing ($\Delta Vim>0$) in the comparison result signal (state A), the CPU 120 determines that the state is in an "uptrend region". Similarly, when Isw is decreasing ($\Delta Isw<0$) and Vim is decreasing ($\Delta Vim<0$) in the comparison result signal (state B), the CPU 120 determines that the state is in the "uptrend region". That is, the CPU 120 determines that the light emission point 116 is operating in the uptrend region shown in FIG. 4. The state A results in the first control mode, and the state B results in the second control mode.

When Isw is increasing and Vim is decreasing in the comparison result signal (state C), the CPU 120 determines that the state is in a "downtrend region". Similarly, when Isw is decreasing and Vim is increasing in the comparison result signal (state D), the CPU 120 determines that the state is in the "downtrend region". That is, the CPU 120 determines that the light emission point 116 is operating in the downtrend region shown in FIG. 4. The state C results in the fourth control mode, and the state D results in the third control mode.

Thus, when the direction of light amount variation of the laser beam is opposite to the direction of driving current variation, the CPU 120 determines that the LD 105 operates in the downtrend region. On the other hand, when the direction of light amount variation of the laser beam is identical to the direction of driving current variation, the CPU 120 determines that the LD 105 operates in the uptrend region.

Figure 7:
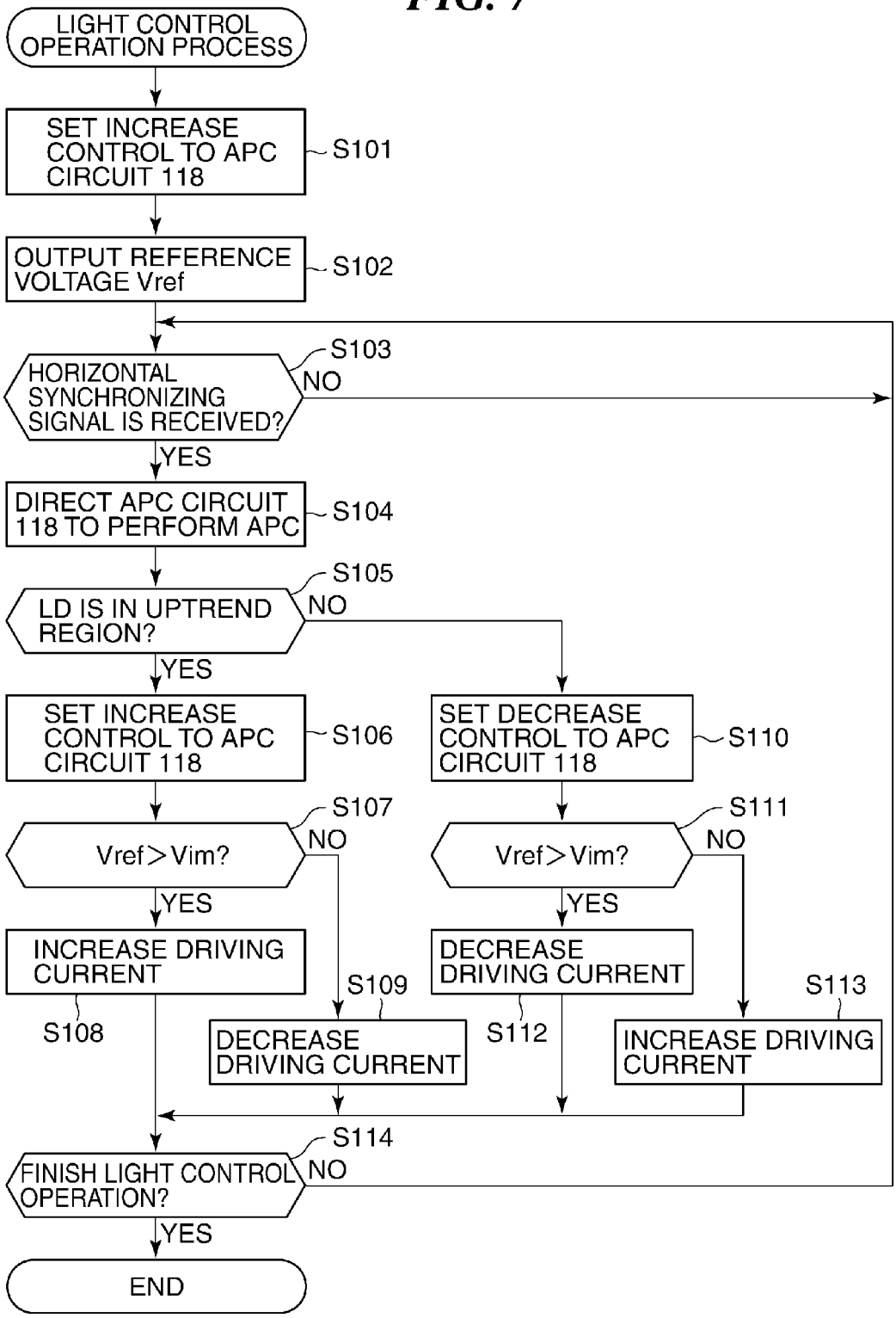
FIG. 7 is a flowchart showing a process executed by the CPU shown in FIG. 3.

FIG. 7 is a flowchart showing a process executed by the CPU 120 shown in FIG. 3.

When an image formation is started, the CPU 120 starts the APC. Then, the CPU 120 sets an increase control to the APC circuit 118 (step S101). Then, the CPU 120 outputs the reference voltage Vref that shows the preset value of the target light amount to the APC circuit 118 (step S102).

The APC circuit 118 directs the IswDAC 119 to increase or decrease the driving current so that the detected voltage Vim matches the reference voltage Vref, whenever the horizontal synchronizing signal is inputted. The APC circuit 118, accordingly, controls the IswDAC 119 to increase or decrease the driving current Isw therefrom so that the laser-beam light amount outputted from the light emission point 116 matches the target light amount.

Next, the CPU 120 determines whether the horizontal synchronizing signal has been received (step S103). When the horizontal synchronizing signal has not been received (NO in the step S103), the CPU 120 waits. When receiving the horizontal synchronizing signal (YES in the step S103), the CPU 120 directs the APC circuit 118 to perform the APC (step S104).

Whenever the APC circuit 118 performs the APC, the Vim differentiating circuit 121 detects variation of the detected voltage Vim and outputs the Vim variation detection signal. Moreover, the Isw differentiating circuit 122 detects change of the driving current Isw, and outputs an Isw variation detection signal. Then, the comparison circuit 123 outputs the comparison result signal as mentioned above. The CPU 120 determines, based on the comparison result signal, whether the operating state of the light emission point 116 is in the uptrend region or the downtrend region. That is, the CPU 120 determines whether the LD is in the uptrend region (step S105).

When determining that the LD is in the uptrend region (YES in the step S105), the CPU 120 sets the increase control to the APC circuit 118 (step S106). The APC circuit 118 compares the reference voltage Vref with the detected voltage Vim, and checks whether the reference voltage Vref is larger than the detected voltage Vim (step S107). When the reference voltage Vref is larger than the detected voltage Vim (YES in the step S107), i.e., when the present light amount is less than the target light amount, the APC circuit 118 increases the driving current Isw in the first control mode (step S108).

On the other hand, when the reference voltage Vref is not larger than the detected voltage Vim (NO in the step S107), i.e., when the present light amount is larger than the target light amount, the APC circuit 118 decreases the driving current Isw in the second control mode (step S109).

When determining that the LD is not in the uptrend region (NO in the step S105), the CPU 120 sets the decrease control to the APC circuit 118 (step S110). The APC circuit 118 compares the reference voltage Vref with the detected voltage Vim, and checks whether the reference voltage Vref is larger than the detected voltage Vim (step S111). When the reference voltage Vref is larger than the detected voltage Vim (YES in the step S111), i.e., when the present light amount is less than the target light amount, the APC circuit 118 decreases the driving current Isw in the third control mode (step S112).

On the other hand, when the reference voltage Vref is not larger than the detected voltage Vim (NO in the step S111), i.e., when the present light amount is larger than the target light amount, the APC circuit 118 increases the driving current Isw in the fourth control mode (step S113).

Following the step S108, S109, S112, or S113, the CPU 120 determines whether or not to finish the APC due to completion of the image formation, etc. (step S114). When determining to finish the APC (YES in the step S114), the CPU 102 finishes the APC. On the other hand, when determining not to finish the APC (NO in the step S114), the CPU 120 returns the process to the step S103.

Thus, the CPU 120 determines whether the LD is in the uptrend region, and then, it sets one of the first, second, third, and fourth control mode according to the determination result. Since the APC is performed in the third or fourth control mode when the driving current applied to the LD exceeds Ipeak that corresponds to the peak value of light amount, the CPU 120 is able to continue the APC. That is, it becomes unnecessary to calculate Ipeak (i.e., the upper limit) again while stopping the image formation, and the time to calculate Ipeak can be shortened as a result.

Subsequently, one example of an image forming apparatus according to a second embodiment of the present invention will be described. It should be noted that the configuration of the image forming apparatus according to the second embodiment is the same as that of the image forming apparatus shown in FIG. 1. Moreover, the configuration of an exposure unit is the same as that of the exposure unit shown in FIG. 2, and the configuration of a light control unit is the same as that of the light control unit shown in FIG. 3. In the second embodiment, the CPU 120 gives a driving current decrease signal (referred to as a current decrease signal, below) to the APC circuit 118 instead of the control-mode-change signal. Then, when determining that the operating state of the emission point 116 enters into the downtrend region, the CPU 120 sends the current decrease signal to the APC circuit 118, as mentioned later.

Figure 8A:
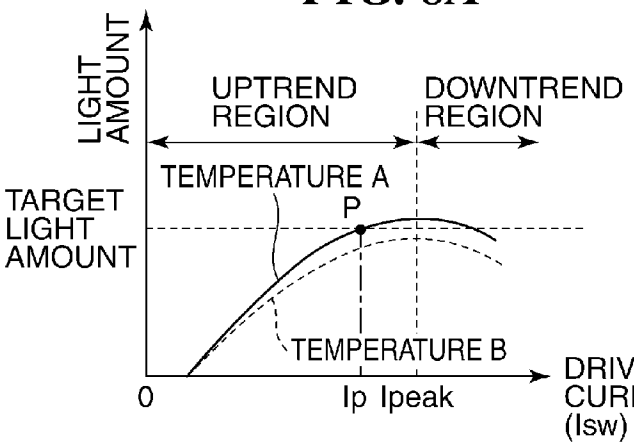
FIG. 8A is a graph showing the current-light characteristic of the surface emitting laser according to a second embodiment of the present invention in which an operation point of the surface emitting laser operated by an APC at a predetermined temperature is indicated.
Figure 8B:
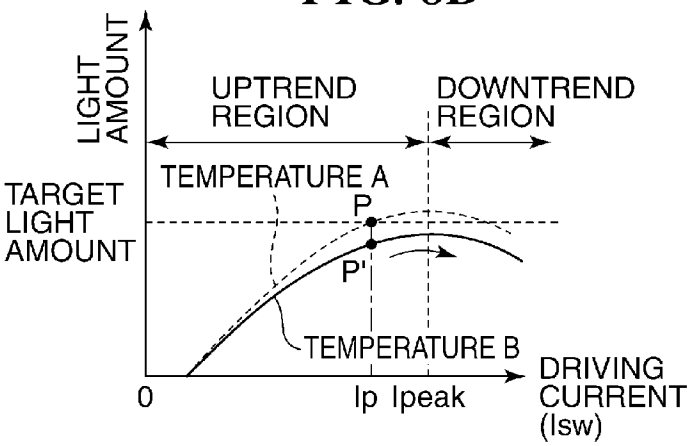
FIG. 8B is a graph showing the current-light characteristic of the surface emitting laser according to the second embodiment of the present invention in which an operation point of the surface emitting laser that is driven by the same driving current at a higher temperature than the predetermined temperature, and variation of the driving current controlled by the APC are indicated.
Figure 8C:
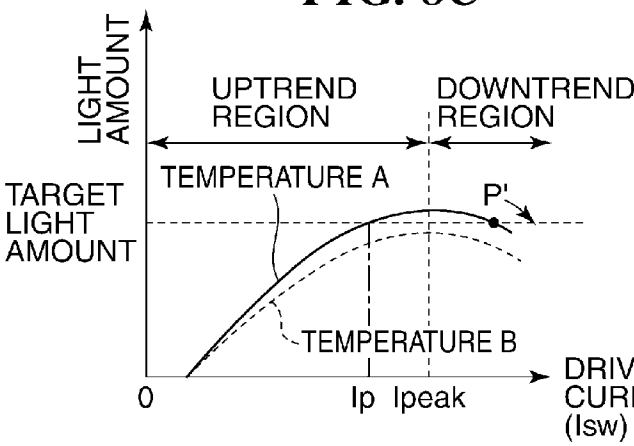
FIG. 8C is a graph showing the current-light characteristic of the surface emitting laser according to the second embodiment of the present invention in which an operation point of the surface emitting laser of which the temperature increases to the higher temperature than the predetermined temperature and then returns to the predetermined temperature, and variation of the driving current controlled by the APC are indicated.
Figure 8D:
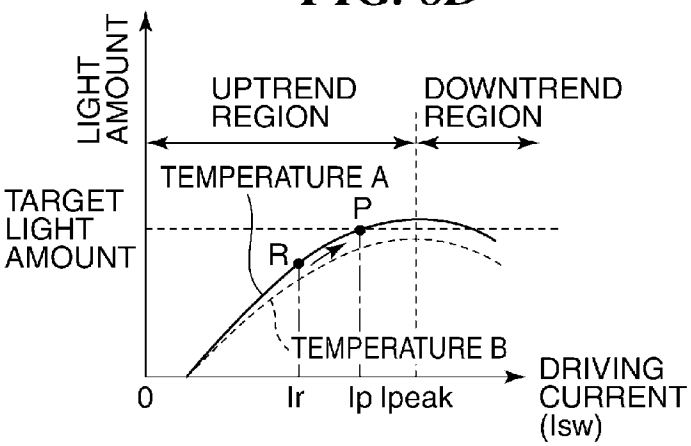
FIG. 8D is a graph showing the current-light characteristic of the surface emitting laser according to the second embodiment of the present invention in which an operation point of the surface emitting laser when receiving a current down signal, and variation of the driving current controlled by the APC are indicated.

FIGS. 8A, 8B, 8C, and 8D are graphs showing the current-light characteristic of the surface emitting laser in the second embodiment. FIG. 8A shows the operation point of the surface emitting laser operated by the APC at a predetermined temperature A. FIG. 8B shows the operation point of the surface emitting laser that is driven by the same driving current at a higher temperature B than the predetermined temperature A, and variation of the driving current controlled by the APC. FIG. 8C shows the operation point of the surface emitting laser of which the temperature increases to the higher temperature B than the predetermined temperature A and then returns to the predetermined temperature A, and variation of the driving current controlled by the APC. FIG. 8D shows the operation point of the surface emitting laser when receiving the current decrease signal, and variation of the driving current controlled by the APC.

It is assumed that the light emission point 116 is driven by the driving current Ip and operates at the operation point P where the target light amount is acquired at the temperature A as shown in FIG. 8A. In this case, the high light emission frequency of the light emission point 116 momentarily increases the temperature of the light emission point 116 due to the heating of the light emission point itself, which varies the current-light characteristic. For example, it is assumed that the variation of the temperature to B from A varies the current-light characteristic to a curve shown by the temperature B from a curve shown by the temperature A. In this time, when the light emission point is driven by the driving current Ip, the operation point of the light emission point shifts to a point P' as shown in FIG. 8B.

When the operation point shifts to the point P', the light amount of the light emission point 116 decreases. As a result, the APC circuit 118 recognizes in the next APC loop that the light amount is insufficient. Then, the APC circuit 118 increases the driving current in order to match the light amount with the target light amount. However, the light amount does not reach the target light amount even if the driving current exceeds the current Ipeak corresponding to the peak value of light amount, and the APC circuit 118 further increases the driving current (see FIG. 8B). Then, even if the temperature of the light emission point 116 returns from the temperature B to the temperature A immediately, the APC circuit 118 can control the driving current only in the direction to increase the driving current by the increase control (see FIG. 8C).

Accordingly, in the second embodiment, when it is determined that the operating state of the light emission point 116 enters into the downtrend region, the operation point of the light emission point 116 is shifted to the point R in the uptrend region as shown in FIG. 8D by decreasing the driving current to a predetermined value Ir. Thus, the operation point of the light emission point 116 is shifted to the point P by performing the APC in the uptrend region, and the light amount of the light emission point 116 is again coincident with the target light amount.

Figure 9:
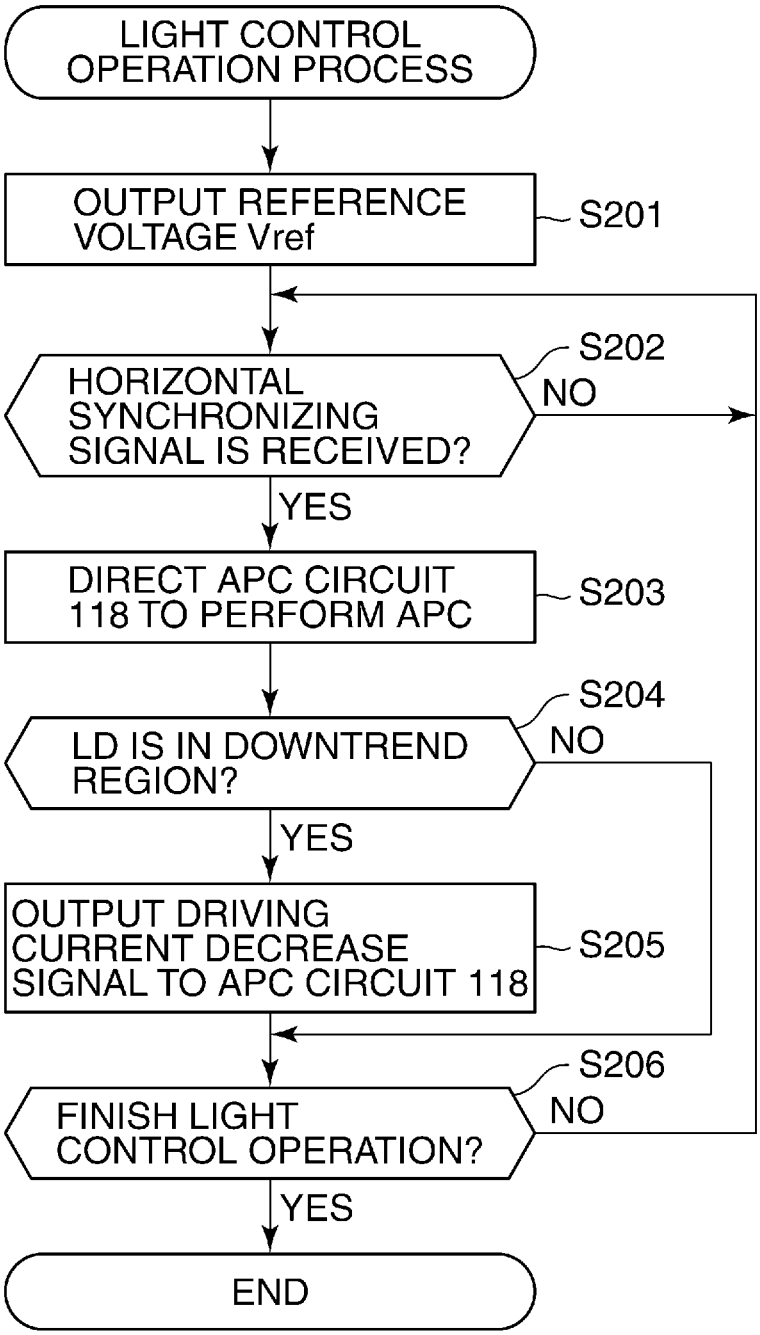
FIG. 9 is a flowchart showing a process executed by the CPU according to the second embodiment of the present invention.

FIG. 9 is a flowchart showing a process executed by the CPU 120 according to the second embodiment of the present invention.

When an image formation is started, the CPU 120 starts the APC. Then, the CPU 120 outputs the reference voltage Vref that shows the preset value of the target light amount to the APC circuit 118 (step S201).

Next, the CPU 120 determines whether the horizontal synchronizing signal has been received from the BD sensor 115 (step S202). When the horizontal synchronizing signal has not been received (NO in the step S202), the CPU 120 waits. When receiving the horizontal synchronizing signal (YES in the step S202), the CPU 120 directs the APC circuit 118 to perform the APC (step S203). Accordingly, the APC circuit 118 performs the APC.

As described in the first embodiment, the Vim differentiating circuit 121 outputs a Vim variation detection signal whenever the APC circuit 118 performs the APC. Moreover, Isw differentiating circuit 122 outputs an Isw variation detection signal. The CPU 120 determines, based on the comparison result signal outputted from the comparison circuit 123, whether the operation point of the light emission point 116 is in the downtrend region (step S204).

When determining that the light emission point 116 is operating in the downtrend region (YES in the step S204), the CPU 120 outputs the driving current decrease signal to the APC circuit 118 (step S205).

When receiving the driving current decrease signal, the APC circuit 118 decreases the driving current. For example, the APC circuit 118 sets the driving current to 80% of the value Ipeak corresponding to the peak value of light amount. That is, the APC circuit 118 decreases the driving current from Ipeak at a predetermined rate.

Then, the CPU 120 determines whether or not to finish the APC due to completion of the image formation, etc. (step S206). When determining to finish the APC (YES in the step S206), the CPU 102 finishes the APC. On the other hand, when determining not to finish the APC (NO in the step S206), the CPU 120 returns the process to the step S202.

When determining that the light emission point is not operating in the downtrend region (NO in the step S204), the CPU 120 proceeds with the process to the step S206.

Thus, in the second embodiment, when the LD is operating in the downtrend region, the APC circuit 118 decreases the driving current from Ipeak at the predetermined rate, and drives the LD. Consequently, even if the driving current exceeds Ipeak, the operating state of the LD can be returned to the uptrend region, and the APC can be continued in the uptrend region.

Subsequently, one example of an image forming apparatus according to a third embodiment of the present invention will be described. It should be noted that the configuration of the image forming apparatus according to the third embodiment is the same as that of the image forming apparatus shown in FIG. 1. Moreover, the configuration of an exposure unit is the same as that of the exposure unit shown in FIG. 2, and the configuration of a light control unit is the same as that of the light control unit shown in FIG. 3. However, in the third embodiment, when determining that the operation state of the light emission point 116 enters into the downtrend region, the CPU 120 directs the APC circuit 118 to decrease the driving current once and directs to decrease the reference voltage Vref that shows the preset value of the target light amount, as mentioned later.

Figure 10A:
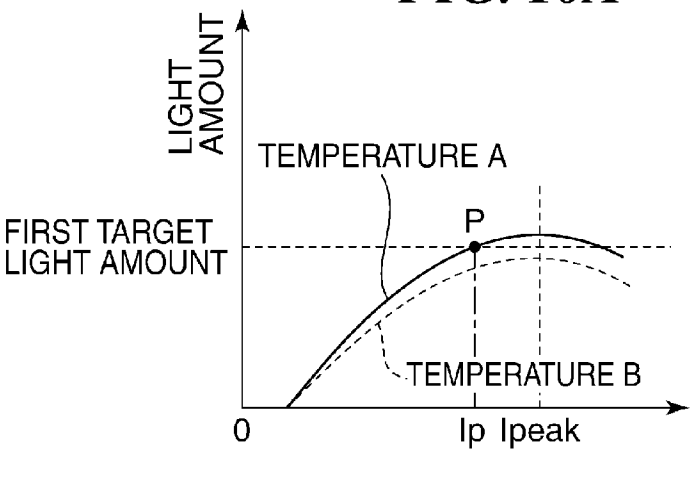
FIG. 10A is a graph showing the current-light characteristic of the surface emitting laser according to a third embodiment of the present invention in which an operation point of the surface emitting laser operated by an APC at a predetermined temperature is indicated.
Figure 10B:
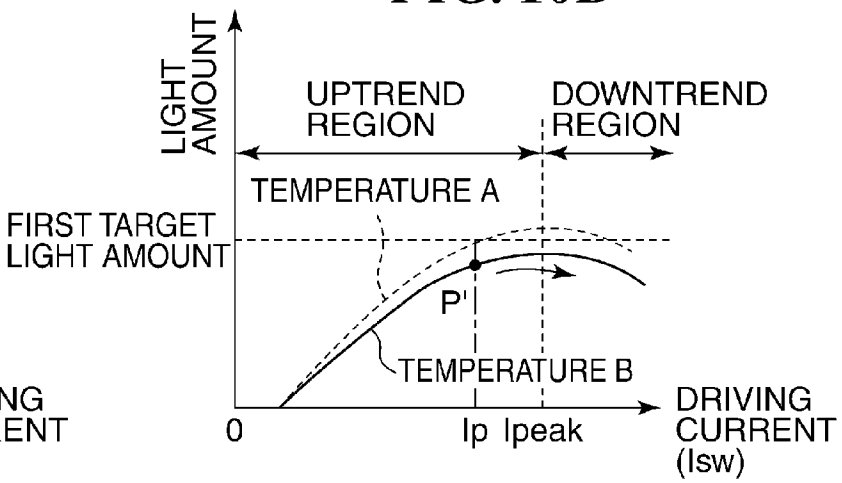
FIG. 10B is a graph showing the current-light characteristic of the surface emitting laser according to the third embodiment of the present invention in which an operation point of the surface emitting laser that is driven by the same driving current at a higher temperature than the predetermined temperature, and variation of the driving current controlled by the APC are indicated.
Figure 10C:
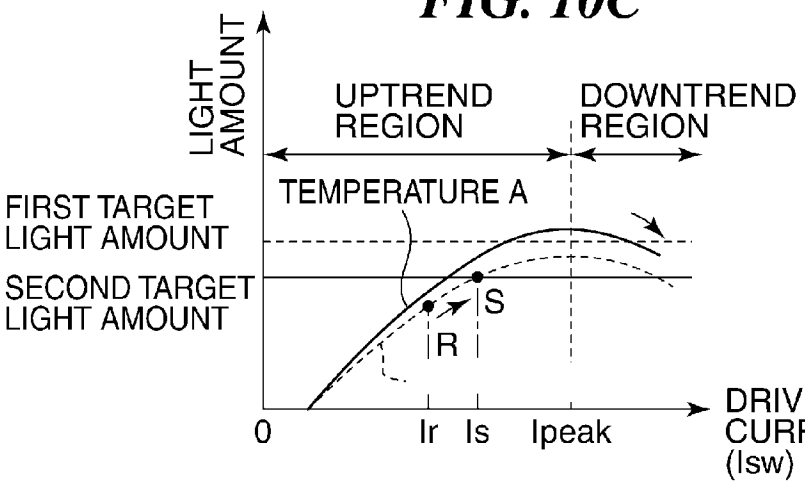
FIG. 10C is a graph showing the current-light characteristic of the surface emitting laser according to the third embodiment of the present invention in which an operation point of the surface emitting laser when decreasing the driving current and decreasing a reference voltage, and variation of the driving current controlled by the APC are indicated.

FIGS. 10A, 10B, and 10C are graphs showing the current-light characteristic of the surface emitting laser in the third embodiment. FIG. 10A shows the operation point of the surface emitting laser operated by the APC at a temperature A. FIG. 10B shows the operation point of the surface emitting laser that is driven by the same driving current at a higher temperature B than the temperature A, and variation of the driving current controlled by the APC. FIG. 10C shows the operation point of the surface emitting laser when the driving current is decreased and the reference voltage Vref is decreased, and variation of the driving current controlled by the APC.

It is assumed that the light emission point 116 is driven by the driving current Ip and operates at the operation point P where the target light amount is acquired at the temperature A as shown in FIG. 10A. In this case, the high light emission frequency of the light emission point 116 momentarily increases the temperature of the light emission point 116 due to the heating of the light emission point itself, which varies the current-light characteristic. For example, it is assumed that the variation of the temperature to B from A varies the current-light characteristic to a curve shown by the temperature B from a curve shown by the temperature A. In this time, when the light emission point is driven by the driving current Ip, the operation point of the light emission point shifts to a point P' as shown in FIG. 10B.

When the operation point shifts to the point P', the light amount of the light emission point 116 decreases. As a result, the APC circuit 118 recognizes in the next APC loop that the light amount is insufficient. Then, the APC circuit 118 increases the driving current in order to match the light amount with the target light amount. However, the light amount does not reach the target light amount even if the driving current exceeds the value Ipeak corresponding to the peak value of light amount, and the APC circuit 118 further increases the driving current (see FIG. 10B).

When the driving current exceeds Ipeak, the light amount of the light emission point 116 decreases with the increase in the driving current, and the operating state of the light emission point 116 enters into the downtrend region. In this case, the driving current is once decreased to the predetermined value Ir, and the operation point of the light emission point 116 is shifted to the point R in the uptrend region (see FIG. 10C). Further, the target light amount is decreased from the initial value (first target light amount) to the lower value (second target light amount).

This stabilizes the laser light amount at the second target light amount by decreasing the target light amount and shifting the operation point of the light emission point 116 from the point R to the point S. In this state, the amount of irradiation light to the photoconductive drum 14 decreases, and the density of a toner image decreases. Thus, the development bias voltage of the development device 23 shown in FIG. 1 is increased so as to obtain sufficient density of a toner image.

Figure 11:
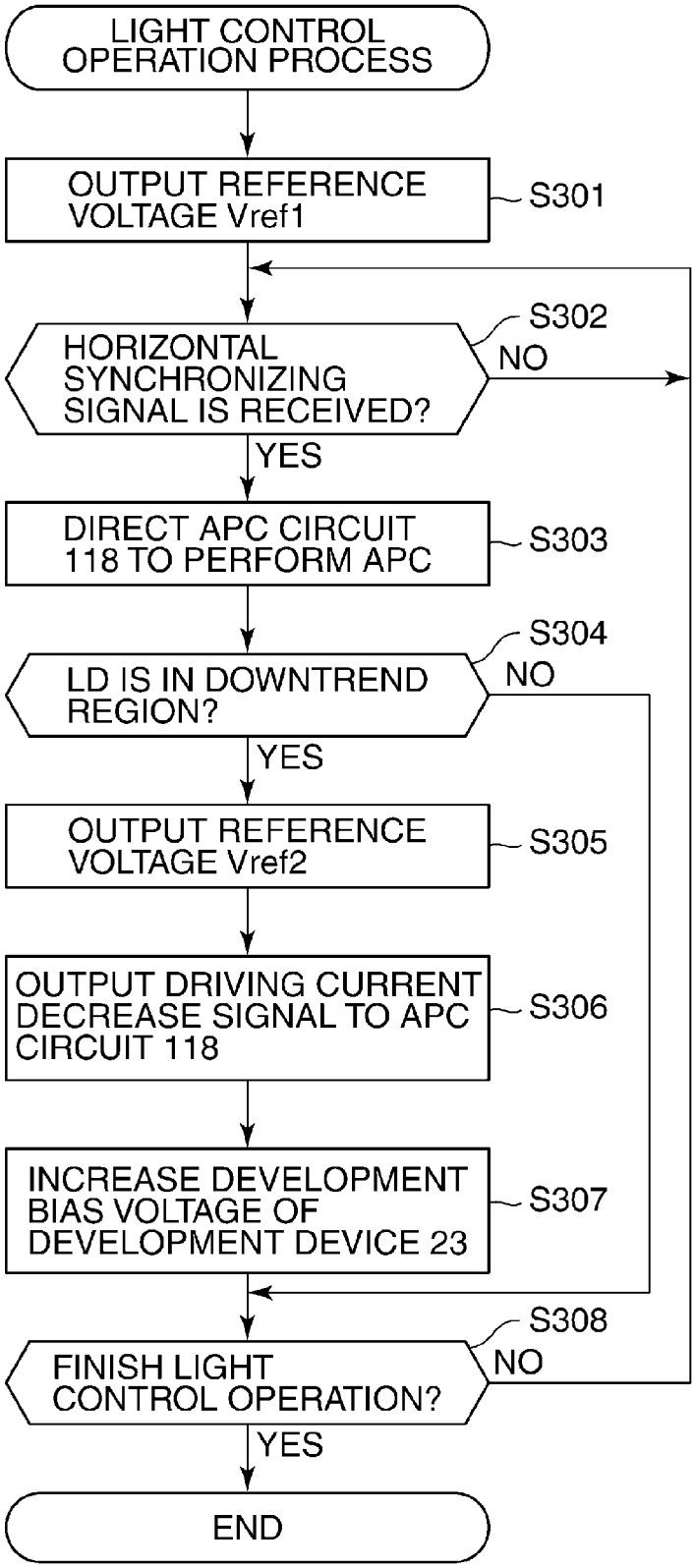
FIG. 11 is a flowchart showing a process executed by the CPU according to a third embodiment of the present invention.

FIG. 11 is a flowchart showing a process executed by the CPU according to a third embodiment of the present invention.

When an image formation is started, the CPU 120 starts the APC. Then, the CPU 120 outputs the reference voltage Vref1 that shows the preset value of the first target light amount to the APC circuit 118 (step S301).

Next, the CPU 120 determines whether the horizontal synchronizing signal has been received from the BD sensor 115 (step S302). When the horizontal synchronizing signal has not been received (NO in the step S302), the CPU 120 waits. When receiving the horizontal synchronizing signal (YES in the step S302), the CPU 120 directs the APC circuit 118 to perform the APC (step S303). Accordingly, the APC circuit 118 performs the APC.

As described in the first embodiment, the Vim differentiating circuit 121 outputs a Vim variation detection signal whenever the APC circuit 118 performs the APC. Moreover, the Isw differentiating circuit 122 outputs an Isw variation detection signal. The CPU 120 determines, based on the comparison result signal outputted from the comparison circuit 123, whether the operation point of the light emission point 116 is in the downtrend region (step S304).

When determining that the light emission point 116 is operating in the downtrend region (YES in the step S304), the CPU 120 outputs reference voltage Vref2 lower than the reference voltage Vref1 to the APC circuit 118 (step S305). The reference voltage Vref2 indicates the preset value corresponding to the second target light amount lower than the first target light amount. For example, the reference voltage Vref2 corresponds to 90% of the peak value of light amount when the peak value becomes a minimum due to the temperature condition of the light emission point 116, etc.

Then, the CPU 120 sets a drive current decrease signal to the APC circuit 118 (step S306). When receiving the driving current decrease signal, the APC circuit 118 decreases the driving current. For example, the APC circuit 118 sets the driving current to 80% of Ipeak. That is, the APC circuit 118 decreases the driving current from Ipeak at a predetermined rate.

Next, the CPU 120 increases the development bias voltage of the development device 23, and changes the development bias voltage (step S307). The changed development bias voltage is the voltage which can acquire a predetermined printing density (density of a toner image) when the second target light amount is set.

Then, the CPU 120 determines whether or not to finish the APC due to completion of the image formation, etc. (step S308). When determining to finish the APC (YES in the step S308), the CPU 102 finishes the APC. On the other hand, when determining not to finish the APC (NO in the step S308), the CPU 120 returns the process to the step S302.

When determining that the light emission point 116 is not operating in the downtrend region (NO in the step S304), the CPU 120 proceeds with the process to the step S308.

Thus, in the third embodiment, the image formation is continuable while keeping the predetermined printing density by decreasing the target light amount and increasing the development bias voltage, even if the LD becomes impossible to generate the laser beam of which the light amount corresponds to the target light amount.

As is evident from the above mentioned description, the photosensor 109, the I-V converter 117, and the Vim differentiating circuit 121 in FIG. 3 function as a light variation detection unit. The IswDAC 119 and the Isw differentiating circuit 122 function as a current variation detection unit. The comparison circuit 123, the CPU 120, and the APC circuit 118 function as a determination unit and a control unit collectively. The CPU 120 functions as a bias change unit.

Although the embodiments of the invention have been described, the present invention is not limited to the above-mentioned embodiments, the present invention includes various modifications as long as the concept of the invention is not deviated.

For example, the functions of the above mentioned embodiments may be achieved as a control method that is executed by an optical scanning apparatus. Moreover, the functions of the above mentioned embodiments may be achieved as a control program that is executed by a computer with which the optical scanning apparatus is provided. It should be noted that the control program is recorded into a computer-readable storage medium, for example.

In this case, the control method and the control program have a light variation detection step, a current variation detection step, a judgment step, and a control step at least.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-227821, filed on Oct. 17, 2011, which is hereby incorporated by reference herein in its entirety.

What is claimed is:

1. A light source control apparatus comprising:

a light source configured to output a light beam of which light amount depends on supplied driving current, wherein a current-light characteristic of the light source includes an uptrend region where the light amount increases with increasing driving current and a downtrend region that touches the uptrend region at a peak value of the light amount and where the light amount decreases with increasing driving current;

a light variation detection unit configured to detect variation of the light amount of the light beam outputted from the light source and to output a light variation detection signal;

a current variation detection unit configured to detect variation of the driving current and to output a current variation detection signal;

a determination unit configured to determine whether the light source is operating in the uptrend region or in the downtrend region based on the light variation detection signal and the current variation detection signal; and a control unit configured to control the driving current so as to match the light amount of the light beam with predetermined target light amount, by increasing the driving current when said determination unit determines that the light source is operating in the uptrend region and when the light amount of light beam is less than the target light amount or when said determination unit determines that the light source is operating in the downtrend region and when the light amount of light beam exceeds the target light amount, and by decreasing the driving current when said determination unit determines that the light source is operating in the uptrend region and when the light amount of light beam exceeds the target light amount or when said determination unit determines that the light source is operating in the downtrend region and when the light amount of light beam is less than the target light amount.

2. The light source control apparatus according to claim 1, wherein said determination unit determines that the light source is operating in the downtrend region when the direction of the light amount variation shown by the light variation detection signal is opposite to the direction of the driving current variation shown by the current variation detection signal, and that the light source is operating in the uptrend region when the direction of the light amount variation shown by the light variation detection signal is identical to the direction of the driving current variation shown by the current variation detection signal.

3. The light source control apparatus according to claim 1, wherein said control unit once decreases the driving current and then increases the driving current in order to make the light source operate in the uptrend region when the light source is operating in the downtrend region.

4. The light source control apparatus according to claim 1, wherein said control unit decreases the target light amount by predetermined amount when the light source is operating in the downtrend region.

5. An image forming apparatus comprising:

the light source control apparatus according to claim 4;

a development unit configured to develop an electrostatic latent image formed on a photoconductor by exposing to a light beam emitted from a light source in order to form a toner image;

a bias change unit configured to changes development bias voltage applied to said development unit when said control unit decreases the target light amount by predetermined amount; and a transferring unit configured to transfer the toner image on the photoconductor to a recording sheet to form an image.

6. An image forming apparatus comprising:

the light source control apparatus according to claim 1;

a development unit configured to develop an electrostatic latent image formed on a photoconductor by exposing to a light beam emitted from a light source in order to form a toner image; and a transferring unit configured to transfer the toner image on the photoconductor to a recording sheet to form an image.

7. A control method for a light source control apparatus that controls a light source that outputs a light beam of which light amount depends on supplied driving current and that exhibits a current-light characteristic including an uptrend region where the light amount increases with increasing driving current and a downtrend region that touches the uptrend region at a peak value of the light amount and where the light amount decreases with increasing driving current, the control method comprising:

a light variation detection step of detecting variation of the light amount of the light beam outputted from the light source and to output a light variation detection signal;

a current variation detection step of detecting variation of the driving current and to output a current variation detection signal;

a determination step of determining whether the light source is operating in the uptrend region or in the downtrend region based on the light variation detection signal and the current variation detection signal; and a control step of controlling the driving current so as to match the light amount of the light beam with predetermined target light amount, by increasing the driving current when it is determined that the light source is operating in the uptrend region in said determination step and when the light amount of light beam is less than the target light amount or when it is determined that the light source is operating in the downtrend region in said determination step and when the light amount of light beam exceeds the target light amount, and by decreasing the driving current when it is determined that the light source is operating in the uptrend region in said determination step and when the light amount of light beam exceeds the target light amount or when it is determined that the light source is operating in the downtrend region in said determination step and when the light amount of light beam is less than the target light amount.

8. A non-transitory computer-readable storage medium storing a control program causing a computer to execute a control method for a light source control apparatus that controls a light source that outputs a light beam of which light amount depends on supplied driving current and that exhibits a current-light characteristic including an uptrend region where the light amount increases with increasing driving current and a downtrend region that touches the uptrend region at a peak value of the light amount and where the light amount decreases with increasing driving current, the control method comprising:

a light variation detection step of detecting variation of the light amount of the light beam outputted from the light source and to output a light variation detection signal;

a current variation detection step of detecting variation of the driving current and to output a current variation detection signal;

a determination step of determining whether the light source is operating in the uptrend region or in the downtrend region based on the light variation detection signal and the current variation detection signal; and a control step of controlling the driving current so as to match the light amount of the light beam with predetermined target light amount, by increasing the driving current when it is determined that the light source is operating in the uptrend region in said determination step and when the light amount of light beam is less than the target light amount or when it is determined that the light source is operating in the downtrend region in said determination step and when the light amount of light beam exceeds the target light amount, and by decreasing the driving current when it is determined that the light source is operating in the uptrend region in said determination step and when the light amount of light beam exceeds the target light amount or when it is determined that the light source is operating in the downtrend region in said determination step and when the light amount of light beam is less than the target light amount.

* * * * *